US005825169A

United States Patent [19]

Selander et al.

[11] Patent Number: 5,825,169

[45] Date of Patent: Oct. 20, 1998

[54] DYNAMICALLY BIASED CURRENT GAIN VOLTAGE REGULATOR WITH LOW QUIESCENT POWER CONSUMPTION

[75] Inventors: Karl D. Selander; Michael A. Sorna, both of Hopewell Junction, N.Y.

[73] Assignee: International Business Machines Corporation, Armonk, N.Y.

[21] Appl. No.: 17,719

[22] Filed: Feb. 4, 1998

[51] Int. Cl.[6] ..... G05F 3/16

[52] U.S. Cl. ..... 323/315; 323/314; 323/350

[58] Field of Search ..... 323/280, 281, 323/312, 313, 314, 315, 316, 350, 351

[56] References Cited

U.S. PATENT DOCUMENTS

| | | | |
|---|---|---|---|
| 4,319,179 | 3/1982 | Jett, Jr. | 323/281 |
| 4,700,124 | 10/1987 | Anderson | 323/351 X |
| 4,906,913 | 3/1990 | Stanojevic | 323/303 |
| 4,950,975 | 8/1990 | Fleischer | 323/266 |
| 5,302,888 | 4/1994 | Hellums et al. | 323/280 |
| 5,448,156 | 9/1995 | Tsay | 323/312 |
| 5,493,203 | 2/1996 | Dalton | 323/282 |
| 5,546,042 | 8/1996 | Tedrow et al. | 327/538 |

OTHER PUBLICATIONS

Dorf, Richard C., The Electrical Engineering Handbook, 1993 pp. 539–541.

Author Unknown, Title Unknown, Date of Publication pp. 341–344.

*Primary Examiner*—Peter S. Wong
*Assistant Examiner*—Y. J. Han
*Attorney, Agent, or Firm*—Ratner & Prestia; H. Daniel Schnurmann

[57] ABSTRACT

A voltage regulator circuit that minimizes the bias current flowing between a first voltage terminal and a second voltage terminal. The circuit receives input signals via a first and a second input terminal, and provides an output signal via an output terminal. The circuit includes a differential input stage, an output stage, a first sub-circuit for reducing the current flowing through the output stage between the first voltage terminal and the output terminal, and a second sub-circuit for reducing the current flowing through the output stage between the output terminal and the second input terminal. An alternative embodiment combines the power reduction circuitry with additional circuitry decoupling the input and output stages to provide enhanced design flexibility.

15 Claims, 4 Drawing Sheets

DYNAMICALLY BIASED CURRENT GAIN VOLTAGE REGULATOR WITH LOW QUIESCENT POWER CONSUMPTION

TECHNICAL FIELD

This invention pertains generally to electronic voltage regulators, and pertains specifically to such voltage regulators implemented with CMOS technology that provides reduced quiescent power consumption.

BACKGROUND OF THE INVENTION

Voltage regulator circuits are typically used in electronic applications to provide a stable, constant DC voltage supply to a load. This DC supply voltage should stay constant regardless of any variations or transients in the load circuit or the supply circuit. When voltage regulators are incorporated into larger circuits, such as on integrated circuit chips, power consumption becomes a design issue. It is desirable to minimize the power consumed and heat generated by each circuit component, including any voltage regulator circuits.

One of the key sources of power inefficiency in a voltage regulator is the bias or quiescent currents flowing through the regulator circuit. Bias or quiescent current is the current drawn by the regulator from its power source to power the internal circuitry of the regulator, rather than to supply to the load of the regulator. The higher the bias current rating of the regulator, the more inefficient the regulator. Thus, there exists a continuing need in the art for voltage regulator circuits that minimize or reduce the bias or quiescent current flowing through the circuit. Such a low-power voltage regulator circuit should be able to drive large capacitive loads, source or sink large currents, operate at a lower Vdd voltage, and be fully integrated (use no off-chip components). Known voltage regulator designs generally cannot simultaneously meet all of these constraints, in large part due to excessive internal power consumption and large bias currents.

Also, the output stages of the voltage regulators are tightly coupled to the input stages of the voltage regulators, so that the current flowing through the output stages is some multiple of the current flowing through the input stages. Although this arrangement may have some advantages, one key disadvantage is that the circuit designer faces some restrictions when adjusting certain circuit parameters, such as offset voltage or gain. With the input and output stages being coupled, it can be difficult to optimize the circuit design because once the input stage is sized, there is no flexibility in sizing the output stage, and vice versa. Accordingly, there is a need in the art for a voltage regulator circuit that decouples the output stage from the input stage, and provides the circuit designer with a more flexible arrangement.

SUMMARY OF THE INVENTION

A voltage regulator circuit is provided that minimizes the bias current flowing between a first voltage terminal and a second voltage terminal. The circuit receives input signals via a first and a second input terminal, and provides an output signal via an output terminal.

The voltage regulator circuit of the invention can drive large capacitive loads of approximately 2 microfarads, source or sink large currents of about 10 milliamps, operate at a lower Vdd voltage of 3 volts, and be fully integrated. The voltage regulator circuit of the invention fulfills these multiple constraints by reducing or minimizing its bias current characteristic and hence its internal power consumption.

The circuit includes six major components: an input stage; an output stage; a first means for controlling the current flowing through the output stage between the first voltage terminal and the output terminal; a first means for draining current from the first controlling means; a second means for controlling the current flowing through the output stage between the second voltage terminal and the output terminal; and a second means for draining current from the second controlling means.

The input stage is coupled to the two input terminals and to the first voltage terminal, and derives a first signal corresponding to the magnitude of the signal applied to the first input terminal, with respect to the signal applied to the second input terminal. The input stage also derives a second signal corresponding to the magnitude of the signal applied to the second input terminal, with respect to the signal applied to the first input terminal. Thus, the relative magnitudes of the first and second signals indicate the differential between the signals applied to the first and second input terminals.

The output stage couples the output terminal to the first and the second voltage terminals. The output stage includes two transistors, a first one being coupled between the first voltage terminal and the output terminal, and a second one being coupled between the output terminal and the second voltage terminal. The circuit can either source current to a load by passing current from the first voltage terminal to the load through the first transistor, or sink current from the load by passing current from the load to the second voltage terminal through the second transistor. The circuit minimizes bias current by reducing the current through the second transistor when the circuit is sourcing current and by reducing the current through the first transistor when the circuit is sinking current.

A first means controls the current flowing through the output stage between the first voltage terminal and the output terminal. This current control means is responsive to the magnitude of the second signal. The first current controlling means is also coupled to the second voltage terminal.

A first means drains current from the first controlling means, and is coupled in parallel with the first controlling means so that current flow through the first draining means reduces the current flow through the first controlling means. The first draining means is responsive to the second signal to control and reduce the current flow through the first draining means. Ultimately, the first draining means controls the current flow through the output stage between the first voltage terminal and the output terminal.

A second means controls the current flowing through the output stage between the output terminal and the second voltage terminal. This current control depends on the magnitude of the first signal. The second current control means is also coupled to the second voltage terminal.

A second means drains current from the second controlling means, and is coupled in parallel with the second controlling means so that current flow through the second draining means reduces the current flow through the second controlling means. The second draining means is responsive to the first signal to control and reduce the current flow through the second draining means. Ultimately, the second draining means controls the current flow through the output stage between the second voltage terminal and the output terminal.

In an alternative embodiment, the invention also provides an improved voltage regulator circuit having an input stage and an output stage, with the output stage being de-coupled from the input stage to allow more design flexibility. The invention improves over known voltage regulators that have their output stages directly mirrored to their input stages by providing additional transistors between the input and output stages. Thus, the offset voltage or gain characteristics of the voltage regulator can be altered by merely modifying the added transistors, rather than altering the input or output transistors.

DETAILED DESCRIPTION OF THE PRIOR ART

Figure 1:
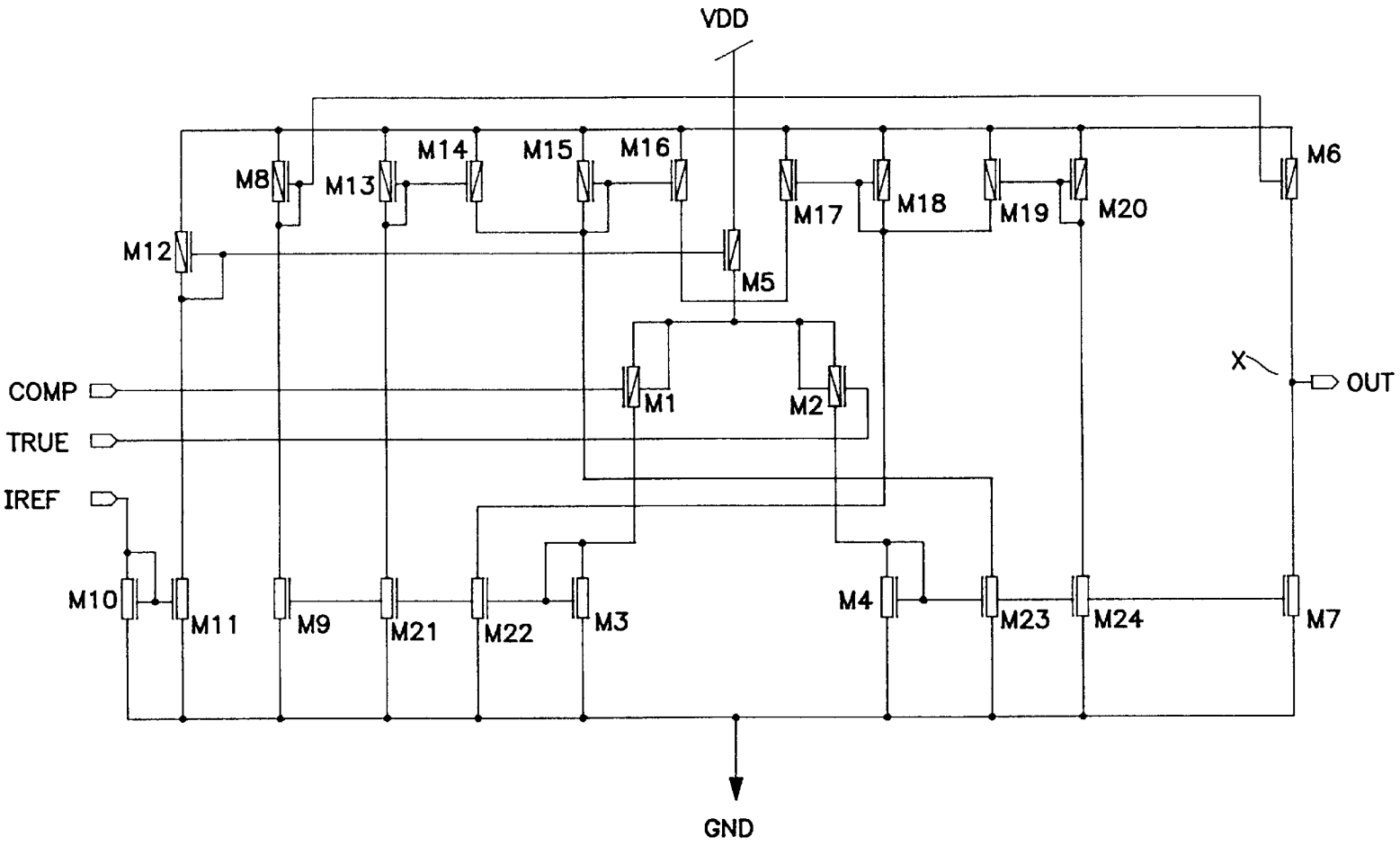
FIG. 1 (PRIOR ART)
FIG. 1 is a schematic diagram of a known voltage regulator circuit.

FIG. 1 is a schematic diagram of a known voltage regulator circuit. This circuit receives input signals through two input terminals labeled COMP and TRUE, and drives an output signal to a load through an output terminal labeled OUT. The signal passing through the OUT terminal is generally fed-back to one of the input terminals, usually the COMP terminal. A reference voltage signal may be supplied to the TRUE terminal. The voltage regulator functions by constantly monitoring the fed-back output signal and comparing it to the reference signal. When those signals become unequal for any reason, the voltage regulator adjusts the output signal as necessary to equalize the two inputs. Typical voltage regulators also connect to two voltage terminals that are part of a power supply. These voltage terminals provide a ground reference and a positive reference for the circuit.

A typical voltage regulator can either source current to the load by passing current from the positive voltage terminal to the output terminal, or sink current from the load by passing current from the load to the negative voltage terminal. Referring to FIG. 1, if the circuit is sourcing current, then a load current passes from voltage supply VDD through transistor M6 to the load through node X, and a bias current may flow from node X through transistor M7 to the ground voltage terminal.

Similarly, if the circuit is sinking current from the load, then a load current passes from the load through node X, and on through transistor M7, and a bias current may flow from the positive voltage terminal through transistor M6 to node X.

Whether the circuit is sinking or sourcing current, these bias currents contribute little to the load, and merely increase the power consumed internally by the voltage regulator circuit. Such bias currents also lead to excessive heat dissipation. A more efficient voltage regulator circuit reduces or minimizes these bias currents.

These bias currents may be better understood by considering the operation of the circuit shown in FIG. 1. Transistors M1 and M2 have their gates connected directly to the COMP and TRUE terminals, respectively, their sources coupled to voltage supply VDD via bias transistor MS, and their drains coupled directly to transistors M3 and M4, respectively. Thus, the COMP and TRUE signals control the current flowing from supply VDD through transistors M1 and M2 to transistors M3 and M4. Since transistors M1 and M2 are p-channel transistors, the higher the signal applied to their gates, the less current they conduct.

If the COMP signal becomes higher than the TRUE signal, then the current flowing through transistor M1 (to which the COMP terminal is connected) is reduced and the current flowing through transistor M2 increases. In this case, transistor M1 is said to become relatively "off" while transistor M2 is said to become relatively "on." The term "relatively" is used in this context to mean that transistors M1 and M2 are unlikely to ever become fully conductive or non-conductive because of the small differential between the signals applied to the COMP and TRUE terminals. Thus, transistors M1 and M2 are said to be "relatively" on or off, rather than "absolutely" on or off.

Any current flowing through transistor M2 flows through transistor M4, which has its gate mirrored to output transistor M7. Transistor M7 typically has a large W/L ratio, as compared to the W/L ratios of other transistors in FIG. 1. Thus, any current flowing through transistor M4 is mirrored to transistor M7 and amplified by a large multiple.

Any current flowing through transistor M1 flows through transistor M3, which has its gate mirrored to transistor M9. When the current flowing through transistor M1 is reduced, the current flowing through transistors M3 and M9 is also reduced. Transistor M9 is in series with transistor M8, so the current flowing through both will be the same. Thus, the current flowing through transistor M8 will be reduced by any current reduction in transistor M9. Transistor M8 has its gate coupled directly to the gate of output transistor M6, so that any current reduction in transistor M8 will be reflected by the current flowing through transistor M6. Output transistor M6 has a large W/L ratio as compared to the other transistors. If transistor M8 turns "off," then transistor M6 will tend to turn "off" as well.

When, for example, the leg of the circuit comprising transistors M1, M3, M9, M8, and M6 is "off," there will still be some current flowing in that "off" leg because the differential between the signals at the COMP and TRUE terminals is likely to be too small to shut off transistor M1 entirely. Thus, some bias current will flow through transistor M6. In light of the large W/L ratio of transistor M6, even a small current flowing in transistor M8 will mirror a larger bias current in transistor M6.

In this example, with the signal at the COMP terminal being greater than the signal at the TRUE terminal, the current flowing through transistor M6 is the bias current. If the signal at the COMP terminal becomes lower than the signal at the TRUE terminal, the above example will be reversed, with the circuit leg comprising transistor M1 becoming "on" and the circuit leg comprising transistor M2 becoming "off." Thus, transistors M3, M9, M8, and M6 become "on," while transistor M7 becomes "off." In this second example, the current flowing through transistor M7 is the bias or quiescent current.

In either example, the bias or quiescent current flowing through the "off" leg of the circuit contributes unnecessarily to the internal power consumption of the circuit. An improved circuit minimizes or reduces the current flowing through the "off" leg of the circuit to thereby minimize or reduce the resulting quiescent power consumption.

A further shortcoming of the circuit of FIG. 1 is that the output stage is coupled directly to the input stage. Specifically, output transistor M7 is mirrored directly from the gate of input transistor M4. Thus, the current flowing through transistor M7 is necessarily a multiple of the current flowing through transistor M4. Once the values for either transistor M4 or transistor M7 are chosen, there is no flexibility in sizing the other transistor.

DETAILED DESCRIPTION OF THE INVENTION

Figure 2:
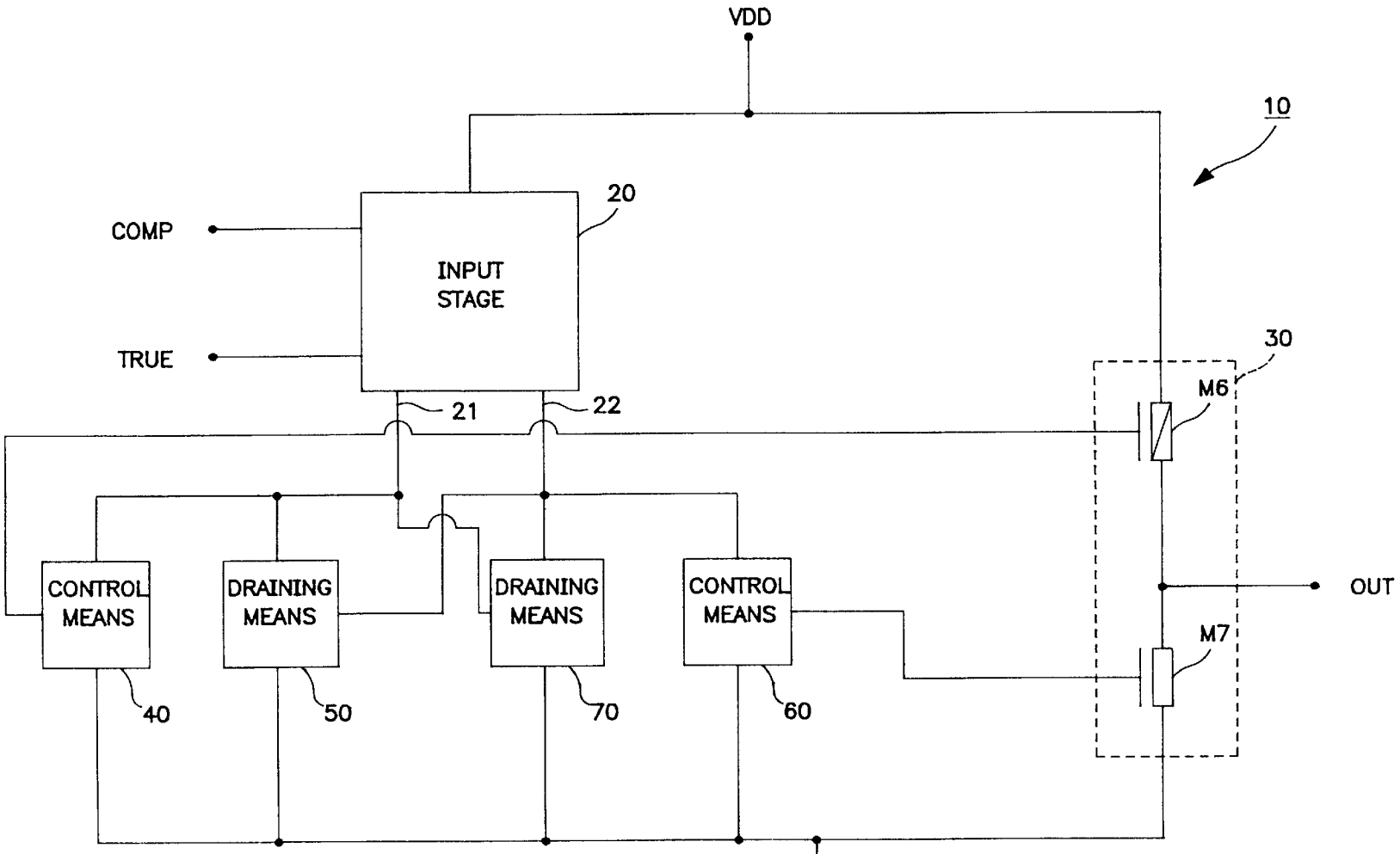
FIG. 2 is a block diagram of the major components of the invention.

FIG. 2 is a block diagram of the major components of the invention. Voltage regulator circuit 10 receives the same external signals as does the circuit depicted in FIG. 1. Thus, circuit 10 connects to a first voltage terminal VDD and a second voltage terminal GND, and has a first input terminal COMP and a second input terminal TRUE, along with an output terminal OUT. The circuit 10 of FIG. 2 minimizes the bias current flowing between the first voltage terminal and the second voltage terminal, thus reducing the quiescent power consumption of the circuit.

The circuit 10 includes six major components: an input stage 20; an output stage 30; a first means 40 for controlling the current flowing through the output stage between the first voltage terminal and the output terminal; a first means 50 for draining current from the first controlling means; a second means 60 for controlling the current flowing through the output stage between the second voltage terminal and the output terminal; and a second means 70 for draining current from the second controlling means.

The input stage 20 is coupled to the input terminals COMP and TRUE and to the first voltage terminal VDD, and derives a first signal, which is supplied along a line 21 and corresponds to the magnitude of the signal applied to the COMP input terminal, with respect to the signal applied to the TRUE input terminal. The input stage 20 also derives a second signal, which is supplied along a line signal 22 and corresponds to the magnitude of the signal applied to the TRUE input terminal, with respect to the signal applied to the COMP input terminal. Thus, the relative magnitudes of the first and second signals supplied along lines 21 and 22 indicate the differential between the signals applied to the COMP and TRUE input terminals.

The output stage 30 couples the output terminal OUT to the first voltage terminal VDD and the second voltage terminal GND. The circuit 10 can either source current to a load by passing current from the first voltage terminal VDD to the load, or sink current from the load by passing current from the load to the second voltage terminal GND.

A first means 40 controls the current flowing through the output stage 30 between the first voltage terminal VDD and the output terminal OUT. The first current controlling means 40 is also coupled to the second voltage terminal GND. First current controlling means 40 is coupled to the input stage 20 to receive the first signal carried on line 21.

A first means 50 drains current from the first current controlling means 40, and is coupled in parallel with the first current controlling means 40 so that current flow through the first draining means 50 reduces the current flow through the first current controlling means 40. The first draining means 50 is responsive to the second signal carried on line 22 from input stage 20 to control the current flow through the first draining means 50 and to reduce the current flow through the first current controlling means 40.

A second means 60 controls the current flowing through the output stage between the second voltage terminal GND and the output terminal OUT. The second current controlling means 60 is also coupled to the second voltage terminal GND. Second current controlling means 60 is coupled to the input stage 20 to receive the second signal carried on line 22 and is coupled to the gate of the second output stage transistor M7 to control the current flowing through the second output stage transistor M7 in response to the current flowing through the second controlling means 60.

A second means 70 drains current from the second controlling means 60, and is coupled in parallel with the second current controlling means 60 so that current flow through the second draining means 70 reduces the current flow through the second current controlling means 60. The second draining means 70 is responsive to the first signal carried on line 21 to control the current flow through the second draining means 70 to reduce the current flow through the second current controlling means 60.

Figure 3:
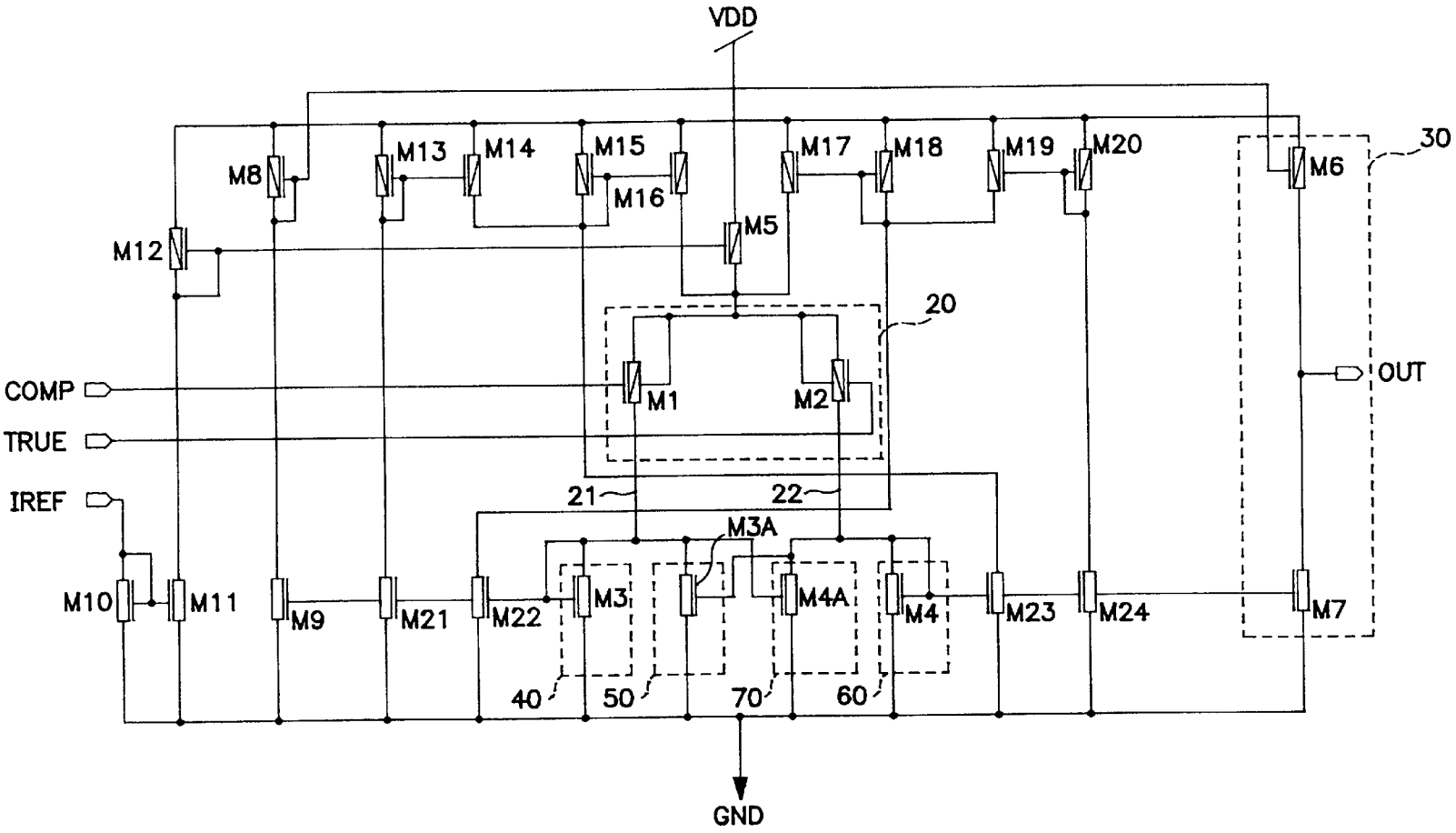
FIG. 3 is a schematic diagram of one embodiment of the invention.

Referring to FIG. 3, each of the major components of the circuit will be explained in progressively more detail.

The input stage 20 (shown in dashed outline) includes a bias transistor M5 having a source coupled to voltage terminal VDD, a gate coupled to the input voltage reference IREF through transistors M12 and M11, and a drain. A first transistor M1 has a gate coupled to the first input terminal COMP, a source coupled to one of the voltage terminals VDD through bias transistor M5, and a drain connected to line 21 along which the first signal is supplied.

The input stage 20 also includes a second transistor M2 having a gate coupled to the second input terminal TRUE, a source coupled to one of the voltage terminals VDD through bias transistor M5, and a drain connected to line 22 along which the second signal is supplied.

The first and second transistors M1 and M2 in the input stage may be p-channel FETs, although n-channel FETs may be suitable in certain environments.

The output stage 30 (shown in dashed outline) includes a transistor M6 having a source coupled to one of the voltage terminals VDD, a drain coupled to the output terminal OUT, and a gate coupled to the first current controlling means 40. Transistor M6 is responsive to the first current controlling means 40 to reduce its current flow and enter a relatively non-conductive state when the voltage applied to the COMP input terminal is less than the voltage applied to the TRUE input terminal. Transistor M6 is coupled to transistor M3 via transistors M9 and M8. Thus, the current flowing through transistor M6 is controlled by the current flowing through transistor M3, such that the bias current passing between the first voltage terminal VDD and the second voltage terminal GND is minimized.

The output stage 30 also includes a transistor M7 having a drain coupled to the output terminal OUT, a source coupled to the other of the voltage terminals GND, and a gate coupled to the second current controlling means 60. Transistor M7 is responsive to the second current control means 60 to reduce its current flow and enter a relatively non-conductive state when the voltage applied to the COMP input terminal is greater than the voltage applied to the TRUE input terminal. The gate of transistor M7 is coupled to the gate of transistor M4. Thus, the current flow through transistor M7 is controlled by the current flowing through transistor M4, such that adjusting the current flow through transistor M7 reduces the bias current passing between the first voltage terminal VDD and the second voltage terminal GND.

Preferably, the first output stage transistor M6 is a p-channel FET, while the second output stage transistor M7 is an n-channel FET, although other configurations may be suitable in certain environments.

The first current controlling means 40 (shown in dashed outline) includes a transistor M3 having a gate and a drain connected to the line 21 carrying the first signal from input stage 20, and a source coupled to the second voltage terminal GND.

The first draining means 50 (shown in dashed outline) includes a cross-coupled transistor M3A with a source and a drain coupled in parallel with the transistor M3, and a gate connected to line 22 carrying the second signal from input stage 20. Transistor M3A is responsive to the second signal carried on line 22 to selectively bleed current from the transistor M3 and to reduce the current flowing through the transistor M3 accordingly.

The second current controlling means 60 (shown in dashed outline) includes a transistor M4 having a gate and a drain coupled to the line 22 carrying the second signal from input stage 20, and a source coupled to the second voltage terminal VDD.

The second draining means 70 (shown in dashed outline) includes a cross-coupled transistor M4A with a source and drain coupled in parallel with the transistor M4, and a gate coupled to line 21 carrying the first signal from input stage 20. Transistor M4A is responsive to the signal carried on line 21 to selectively bleed current from the transistor M4 and to reduce the current flowing through the transistor M4 accordingly.

Preferably, transistors M3, M4, M3A, and M4A are n-channel FETs, although other configurations may be suitable in certain environments.

Transistors M3A and M4A may be said to be cross-coupled because they each connect to the drains of both transistors M1 and M2. Compare FIG. 1, wherein transistor M3 connects to the drain of only transistor M1, while transistor M4 connects to the drain of only transistor M3. In FIG. 3, any current flowing from the drain of transistor M1 flows into the drains of transistors M3 and M3A, and is also presented to the gate of transistor M4A. Likewise, any current flowing from the drain of transistor M2 flows into the drains of transistors M4 and M4A, and is also presented to the gate of transistor M3A.

The current flowing in transistor M3 is mirrored to transistor M9, which, in turn, controls the current flow through transistor M8 and output transistor M6. Similarly, the current flowing through transistor M4 is mirrored to output transistor M7.

Cross-coupled transistors M3A and M4A operate as follows. The circuit will operate in one of two basic scenarios: first, transistor M1 will be "off" while transistor M2 is "on;" second, transistor M1 will be "on" while transistor M2 is "off."

If, for example, transistor M1 is "off" and transistor M2 is "on," then more current will flow through transistor M2 than transistor M1. The higher current from transistor M2 will flow into the drains of both transistors M4 and M4A, and will be presented to the gate of transistor M3A. The lower current from transistor M1 will flow into the drains of transistors M3 and M3A. Transistor M3A is mirroring the higher current from transistor M2 through transistor M4. Transistor M3A will be driven to conduct more current by the higher current flow from transistor M2, causing transistor M3A to conduct more current than transistor M3. Thus, transistor M3A will bleed current from transistor M3 and reduce the current flow through transistor M3.

The current flow through transistor M3 ultimately controls the current flowing through output transistor M6, because transistor M3 is mirrored directly to transistor M9. Thus, this cross-coupling arrangement forces output transistor M6 to a more "off" state than does the arrangement illustrated in FIG. 1, because transistor M3A uses the current flow in the "on" leg of the circuit to draw down the current in transistor M3. With output transistor M6 conducting less current, the bias current flowing through output transistor M6 is reduced, thereby minimizing the quiescent power consumption and heat dissipation characteristics of the circuit.

The above discussion assumed that transistor M1 is "off" and transistor M2 is "on," but were transistor M1 "on" and transistor M2 "off," the same operative principles would apply in reverse. The current from transistor M1 would flow into the drains of transistors M3 and M3A and into the gate of transistor M4A. The higher current flow through transistor M1 would thus cause transistor M4A to conduct more current, thus drawing or bleeding current from transistor M4. Since transistor M4 is mirrored directly to output transistor M7, the lower the current flow through transistor M4, the less current transistor M7 will conduct. The less current transistor M7 conducts, the less bias current flows through transistor M7, thereby reducing the quiescent power consumption and heat dissipation characteristics of the circuit.

Figure 4:
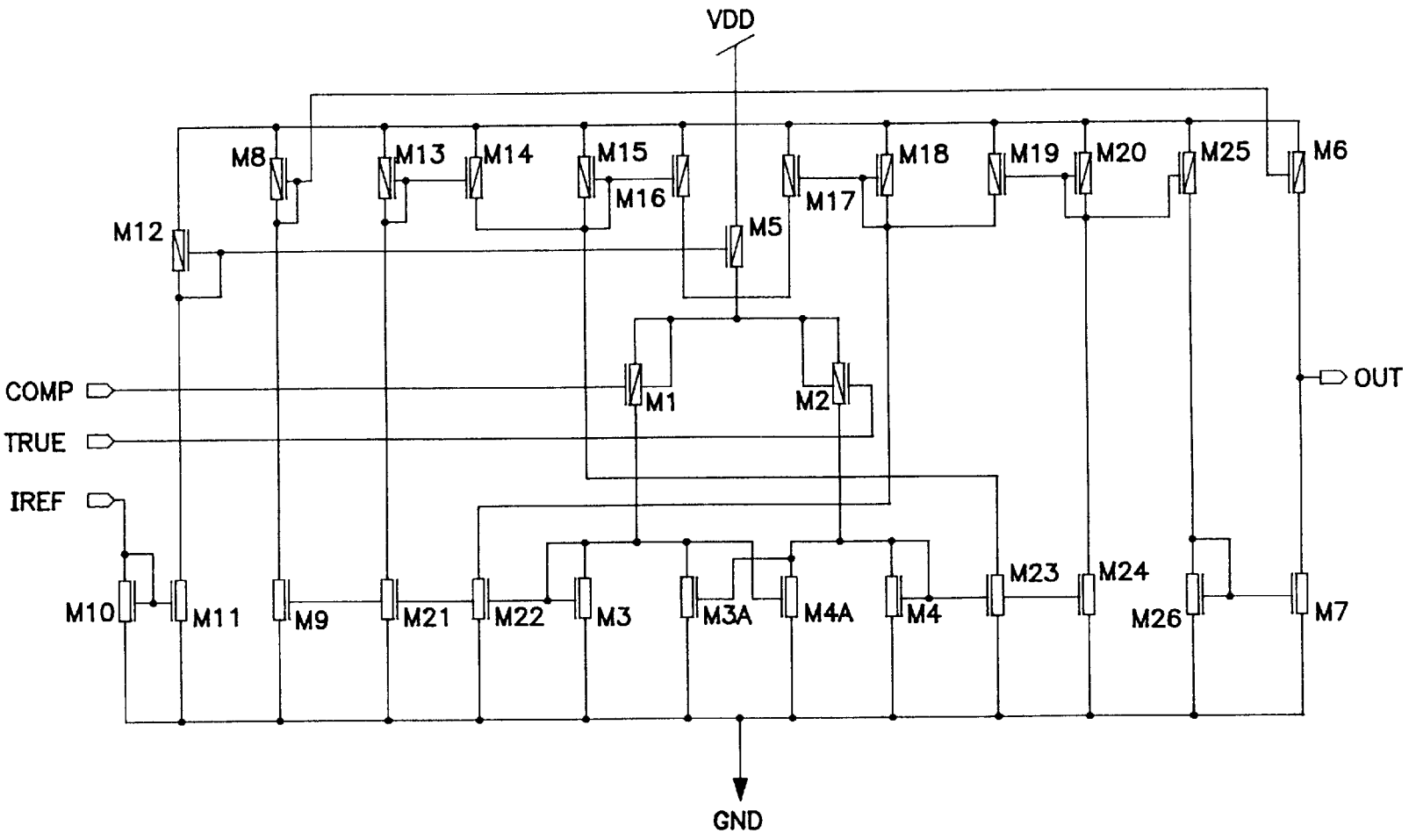
FIG. 4 is a schematic diagram of another embodiment of the invention.

FIG. 4 is a schematic diagram of another embodiment of the invention. This embodiment is similar to that shown in FIG. 3, but adds transistors M25 and M26. These latter two transistors decouple the output stage transistors M6 and M7 from the input stage 20 of the circuit. As discussed above, the circuit shown in FIG. 1 is somewhat inflexible because the input stage 20 is tightly coupled to the output stage 30. In FIG. 1, transistor M4 is mirrored directly to output transistor M7. Once the input stage transistors M3 or M4 are sized, there is no flexibility in sizing the output stage transistors M6 or M7, and vice versa. This constraint can be a limitation if a designer wishes to adjust certain circuit parameters, such as offset voltage or gain.

The addition of transistors M25 and M26 provides the circuit designer with considerably more flexibility. Transistor M25 has its source coupled directly to one of the voltage terminals VDD, its gate coupled ultimately to transistor M4, and has a drain. Transistor M26 has its drain and gate coupled to the drain of transistor M25, its source coupled to the voltage terminal GND, and its current flow mirrored to the gate of M7. Thus, if the designer wishes to adjust parameters such as the offset voltage or the gain, transistors M25 and M26 may be modified without having to re-design the input or output stages of the circuit. Preferably, M25 is a p-channel FET, while M26 is an n-channel FET.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed:

1. A voltage regulator circuit for minimizing the bias current flowing between a first voltage terminal and a second voltage terminal, the circuit comprising:

a first input terminal for receiving a first input signal;

a second input terminal for receiving a second input signal;

an output terminal;

an input stage coupled to said first and said second input terminals and to the first voltage terminal, said input stage deriving:

(a) a first signal corresponding to the magnitude of the first input signal with respect to the second input signal; and (b) a second signal corresponding to the magnitude of the second input signal with respect to the first input signal;

whereby the relative magnitudes of the first and the second signals indicate the relative magnitudes of the signals applied to said first and second input terminals;

an output stage coupling said output terminal to the first and the second voltage terminals, said output stage including:

a first output stage transistor having a source coupled to one of the voltage terminals, a drain coupled to said output terminal, and a gate; and a second out stage transistor having a drain coupled to said output terminal, a source coupled to the other voltage terminal, and a gate;

first means for controlling the current flowing through said first output stage transistor and coupled to said input stage to receive the first signal and coupled to said gate of said first output stage transistor to control the current flowing through said first output stage transistor in response to the current flowing through said first current controlling means;

first means for draining current from said first current controlling means and coupled in parallel with said first current controlling means so that current flow through said first draining means reduces current flow through said first current controlling means, said first draining means responsive to the second signal to control current flow through said first draining means to reduce current flow through said first current controlling means;

second means for controlling the current flowing through said second output stage transistor and coupled to said input stage to receive the second signal and coupled to said gate of said second output stage transistor to control the current flowing through said second output stage transistor in response to the current flowing through said second current controlling means; and second means for draining current from said second current controlling means and coupled in parallel with said second current controlling means so that current flow through said second draining means reduces current flow through said second current controlling means, said second draining means responsive to the first signal to control current flow through said second draining means to reduce current flow through said second current controlling means.

2. The circuit of claim 1, wherein said input stage includes:

(a) a bias transistor having a source coupled to one of the voltage terminals, having a drain, and having a gate;

(b) a first input stage transistor having a gate coupled to said first input terminal, a source coupled to said bias transistor, and a drain at which the first signal is derived; and (c) a second input stage transistor having a gate coupled to said second input terminal, a source coupled to said bias transistor, and a drain at which the second signal is derived.

3. The circuit of claim 2, wherein said first and said second input stage transistors are p-channel transistors.

4. The circuit of claim 1, wherein said first current controlling means includes:

(a) a transistor having a drain coupled to said input stage to receive the first signal, a source coupled to the second voltage terminal, and a gate coupled to said first output stage transistor; and (b) a transistor having a drain coupled to said input stage to receive the second signal, a source coupled to the second voltage terminal, and a gate coupled to said second output stage transistor.

5. The circuit of claim 1, wherein said first draining means includes:

(a) a transistor having a drain coupled to said input stage to receive the first signal, a source coupled to the second voltage terminal, and a gate coupled to said input stage to receive the second signal; and (b) a transistor having a drain coupled to said input stage to receive the second signal, a source coupled to the second voltage terminal, and a gate coupled to said input stage to receive the first signal.

6. The circuit of claim 1, wherein said first output stage transistor is a p-channel transistor, and said second output stage transistor is an n-channel transistor.

7. The circuit of claim 1, wherein said first and said second current controlling means and said first and second draining means are coupled to the second voltage terminal.

8. A voltage regulator circuit for minimizing the bias current flowing between a first voltage terminal and a second voltage terminal, the circuit comprising:

a first input terminal;

a second input terminal;

an output terminal;

a bias transistor having a source coupled to one of the voltage terminals and having a drain;

a first input stage transistor responsive to a signal applied to said first input terminal, and having a gate coupled to said first input terminal, a source coupled to said bias transistor, and a drain;

a second input stage transistor responsive to a signal applied to said second input terminal, and having a gate coupled to said second input terminal, a source coupled to said bias transistor, and a drain;

a first current controlling transistor having a drain connected to said drain of said first input stage transistor, a source coupled to the second voltage terminal, and a gate;

a first draining transistor coupled in parallel with said first current controlling transistor and responsive to the current flowing through said second input stage transistor to selectively bleed current from said first current controlling transistor to reduce the current flowing through said first current controlling transistor, said first draining transistor having a gate connected to said drain of said second input stage transistor;

a second current controlling transistor having a drain coupled to said drain of said second input stage transistor, a source coupled to the second voltage supply, and a gate;

a second draining transistor coupled in parallel with said second current controlling transistor and responsive to the current flowing through said first input stage transistor to selectively bleed current from said second current controlling transistor to reduce the current flowing through said second current controlling transistor, said second draining transistor having a gate connected to said drain of said first input stage transistor;

an output stage coupling said output terminal to the first and the second voltage terminals, and having:

(a) a first output stage transistor responsive to said first current controlling transistor to minimize the bias current flowing between the first one of the voltage terminals and said output terminal, and having a source coupled to a first one of the voltage terminals, a drain coupled to said output terminal, and a gate coupled to said gate of said first current controlling transistor; and (b) a second output stage transistor responsive to said second current controlling transistor to minimize the bias current flowing between the other one of the voltage terminals and said output terminal, and having a drain coupled to said output terminal, a source coupled to the other voltage terminal, and a gate coupled to said gate of said second current controlling transistor.

9. The circuit of claim 8, wherein said first and said second input stage transistors, and said first output stage transistors are p-channel transistors.

10. The circuit of claim 8, wherein said first and said second controlling transistors, said first and said second draining transistors, and said second output stage transistor are n-channel transistors.

11. The circuit of claim 8, wherein said sources of said first and said second current controlling transistors and said sources of said first and said second draining transistors are coupled to the second voltage terminal.

12. A voltage regulator circuit for minimizing the bias current flowing between a first voltage terminal and a second voltage terminal, the circuit comprising:

a first input terminal receiving a first input signal;

a second input terminal receiving a second input signal;

an output terminal;

an input stage coupled to said first and said second input terminals and to the first voltage terminal, and deriving:

(a) a first signal corresponding to the magnitude of the first input signal with respect to the second input signal; and (b) a second signal corresponding to the magnitude of the second input signal with respect to the first input signal;

whereby the relative magnitudes of the first and the second signals indicate the relative magnitudes of the signals applied to said first and said second input terminals;

an output stage coupling said output terminal to the first and the second voltage terminals, and having:

(a) a first output stage transistor having a source coupled to one of the voltage terminals, a drain coupled to said output terminal, and a gate; and (b) a second output stage transistor having a drain coupled to said output terminal, a source coupled to the other voltage terminal, and a gate;

first means for controlling the current flowing through said first output stage transistor, said first current controlling means coupled to said input stage to receive the first signal and coupled to the gate of said first output stage transistor to control the current flowing through said first output stage transistor in response to the current flowing through said first current controlling means;

first means for draining current from said first current controlling means, said first draining means coupled in parallel with said first current controlling means so that current flow through said first draining means reduces the current flow through said first current controlling means, said first draining means responsive to the second signal to control the current flow through said first draining means to reduce the current flow through said first current controlling means;

second means for controlling the current flowing through said second output stage transistor, said second controlling means coupled to said input stage to receive the second signal and coupled to the gate of said second output stage transistor to control the current flowing through said second output stage transistor in response to the current flowing through said second current controlling means;

second means for draining current from said second current controlling means, said second draining means coupled in parallel with aid second current controlling means so that current flow through said second draining means reduces the current flow through said second current controlling means, said second draining means responsive to the first signal to control the current flow through said second draining means to reduce the current flow through said second current controlling means; and means for decoupling said input stage from said output stage, said decoupling means coupled between the first voltage terminal and the second voltage terminal and between said input stage and said output stage.

13. The circuit of claim 12, wherein said decoupling means includes:

(a) a first decoupling transistor having a source coupled to a first one of the voltage terminals, a gate coupled to said second current controlling means, and having a drain; and (b) a second decoupling transistor having a drain coupled to said drain of said first decoupling transistor, a source coupled to the other voltage terminal, and having a gate coupled to said output stage.

14. The circuit of claim 13, wherein said first decoupling transistor is a p-channel transistor, and said second decoupling transistor is an n-channel transistor.

15. The circuit of claim 13, wherein said gate of said second decoupling transistor is coupled to said gate of said second output stage transistor.

* * * * *